United States Patent [19]

Tomson

[11] 4,257,185

[45] Mar. 24, 1981

[54] BUBBLE PRODUCING, PRESERVING AND DISPLAY APPARATUS

[76] Inventor: Steven H. Tomson, R.D. No. 4, Cazenovia, N.Y. 13035

[21] Appl. No.: 27,273

[22] Filed: Apr. 5, 1979

[51] Int. Cl.[3] ..... B42F 13/00

[52] U.S. Cl. ..... 46/6; 40/408

[58] Field of Search ..... 46/1 R, 6, 7, 8; 40/406, 407, 408, 427, 402

[56] References Cited

U.S. PATENT DOCUMENTS

| | | | |
|---|---|---|---|
| 445,807 | 2/1891 | Farrand | 40/7 |
| 1,550,057 | 8/1925 | Beeier | 40/408 |
| 1,580,598 | 4/1926 | Grotta | 46/7 |
| 2,589,757 | 3/1952 | Williams | 40/406 |
| 2,711,612 | 6/1955 | Wister | 46/7 |
| 2,942,375 | 6/1960 | Bucic | 46/7 |
| 3,395,481 | 8/1968 | Galloway | 46/6 |
| 3,971,157 | 7/1976 | Gillis | 46/7 |
| 4,085,533 | 4/1978 | Ewald | 40/427 |

*Primary Examiner*—Louis G. Mancene
*Assistant Examiner*—Wenceslao J. Contreras
*Attorney, Agent, or Firm*—Brumbaugh, Graves, Donohue & Raymond

[57] ABSTRACT

The invention disclosed by this application relates to a device for producing, preserving and displaying a bubble which comprises a casing which is at least partially transparent, a bubble forming conduit mounted within the casing and having an inlet and a bubble forming outlet, means for applying a bubble forming film to the outlet, and pressurizing means for increasing the pressure within the conduit to a point greater than the pressure within the casing, so that a bubble forms on the conduit outlet.

51 Claims, 4 Drawing Figures

BUBBLE PRODUCING, PRESERVING AND DISPLAY APPARATUS

FIELD OF THE INVENTION

This invention relates to an apparatus for producing and preserving bubbles within a closed system.

DESCRIPTION OF THE PRIOR ART

The prior art discloses amusement or advertising devices for displaying bubbles. For example, Beeler U.S. Pat. No. 1,550,057 discloses a glass jar retained within a cylindrical member containing bubble solution. In operation, bubbles are formed by forcing air through the bubble solution. The bubbles formed fill the glass jar and overflow into a reservoir containing bubble solution and rapidly condense back into solution.

Stott, U.S. Pat. No. 971,091 discloses an advertising or amusement device for blowing bubbles which comprises a cylinder containing bubble-forming solution through which air is forced. The bubbles formed by the passage of the air through the solution fill the cylinder and overflow onto a basin.

Steinhauser U.S. Pat. No. 710,814 also discloses an advertising device for blowing bubbles which comprises a soap holder, above which a tube member, surrounded by a receiving pan is disposed. In operation, air is forced through the soapy liquid thereby forming bubbles which fill the tube and overflow onto the receiving plate. The bubbles rapidly burst on the receiving plate and the soapy liquid of which the bubble was formed is channeled back into the soap holder.

BRIEF DESCRIPTION OF THE INVENTION

It is an object of this invention to provide an apparatus for producing a display bubble for prolonged observation within a casing, wherein the bubble is produced simply by the flow of bubble forming liquid within the internal structure of the apparatus.

In accordance with the foregoing objective, the invention provides an apparatus for producing, observing and preserving a bubble comprising:

(a) A casing which is at least partially transparent, having an upper portion and a lower portion, and (b) a bubble forming conduit attached at one end to the upper portion of the casing and having an inlet closest to said point of attachment and a bubble forming outlet furthest from said point of attachment, and (c) bubble forming liquid contained within the casing such that the bubble forming outlet of the conduit contacts the liquid; and wherein the amount of liquid in the casing is adjusted so that when the casing is inverted, the conduit outlet is above the surface of the liquid, and the conduit inlet is below the surface of the liquid so that liquid will flow from the casing and into the conduit thereby causing a bubble to form on the bubble forming conduit outlet.

This invention also provides, in a second embodiment, an apparatus for producing, preserving and observing a bubble comprising:

(a) A casing which is at least partially transparent, having an upper portion and a lower portion, and (b) a bubble forming conduit attached at one end to the upper portion of the casing such that the conduit extends generally vertically downwardly from the upper portion of the casing, and wherein the conduit includes an inlet closest to said point of attachment and a bubble forming outlet furthest from said point of attachment and, (c) means for applying a film of bubble forming liquid to the bubble forming conduit outlet and, (d) bubble forming liquid contained within the casing so that when the casing is inverted the bubble forming conduit outlet will be above the surface of the liquid and the conduit outlet will be below the surface of the liquid so that liquid will flow from the casing and into the conduit thereby causing a bubble to form on the bubble producing conduit outlet.

Still other objects and advantages of the present invention will be apparent from the Detailed Description of The Invention section of this application and the attached drawings wherein:

FIG. 1: is a cross-sectional view representing the apparatus in its rest position, showing the bubble forming liquid just contacting the open end portion of the conduit, taken along line 2 of FIG. 3.

FIG. 2: is a vertical section view of the apparatus in its display position, showing a partially formed bubble mounted on the conduit and bubble forming liquid partially filling the conduit.

FIG. 3: is a top elevational view.

FIG. 4: is a vertical section of an alternative embodiment of the apparatus in its rest position.

DETAILED DESCRIPTION OF THE INVENTION

The present invention relates to an apparatus and method for producing a bubble with a self-contained closed apparatus. Significantly, the display bubble is produced simply by the flow of bubble forming liquid within the internal structure of the apparatus and, hence, an external air supply is not required for the production of a bubble within the apparatus.

Figure 4:
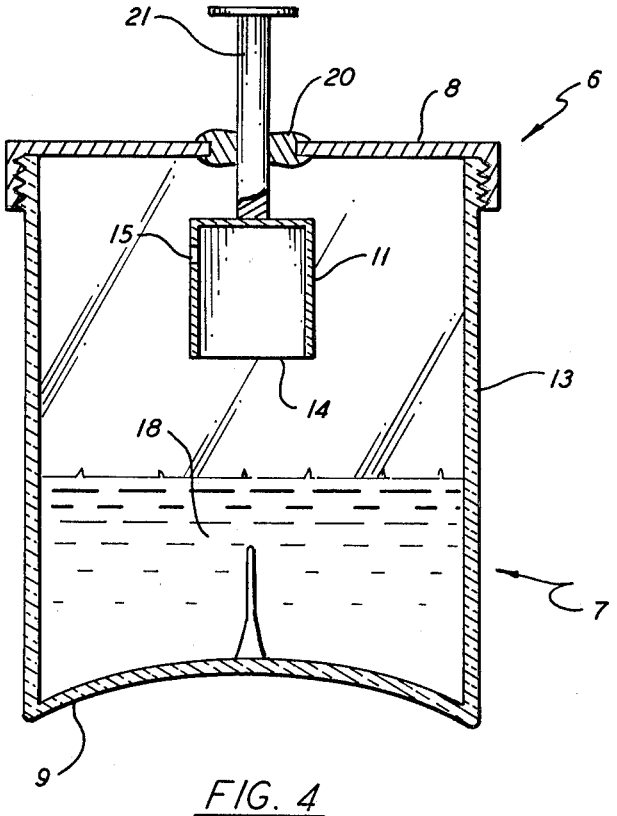

The terms "upper" and "lower" employed by this description of the invention, are intended to refer to FIGS. 1 and 4 which, as will be discussed below, illustrate the device in its rest position.

The bubble producing apparatus of this invention indicated generally by reference number 6, comprises in its preferred embodiment, a generally cylindrical casing 7 having a lower base member 13 and a detachable cap member 8 which forms the uppermost portion of the casing 7.

The cap member 8 is secured to the base member 13 to provide a liquid-tight seal between the base member 13 and the cap member 8. For example, in the embodiment represented by FIG. 1, the cap member 8 is provided with a lip 10 having threads which cooperate with threads located on the outer surface of the uppermost end 12 of the casing base member 13, to provide a liquid-tight seal between the casing base member 13 and cap member 8. As an alternative to the use of a threaded cap, the cap member may comprise a cork or rubber plug which is adapted to frictionally engage the upper portion 8 of the casing 7.

The cap member 8 may also be permanently or hermetically sealed to the base member 13 to provide a permanently sealed liquid-tight closed system. The cap member 8 may be sealed to the base 13 with any glue or epoxy which is compatable with the bubble forming liquid contained with the casing. A sealed casing may be desireable when employing the device as a child's toy since the apparatus could not be accidentally opened during use. However, a detachable cap would be preferred where it is desired from time to time to drain and replace the bubble forming solution employed within the device—as, for example where it is desired to vary the color of the bubble forming solution employed within the device.

The casing may be formed of transparent materials such as glass or clear plastics such as polymethylmethacrylate. The casing may also be formed of non-transparent materials such as wood or a colored plastic, and a viewing window formed of a transparent material such as glass or cellophane may be provided in an appropriate position on the casing wall.

The internal structure of the apparatus is defined by the bubble forming conduit member 11 which is closed at one end and open at the opposite end 14. The closed end of the conduit is secured to the upper portion 8 of the casing so that the conduit 11 extends vertically downwardly from the upper portion 8 of the casing toward the lower or convex portion of the casing.

The bubble forming conduit 11 includes an inlet port 15 which provides a means of communication between the interior area of the casing 17 and the interior area 16 of the conduit.

The bubble forming conduit 11 may be formed of wood, glass, plastic or ceramic and may be secured to the casing with any glue, epoxy or other adhesive material which is compatable with the bubble forming liquid. Alternatively, the casing 7 and conduit 11 may be cast, for example, from ceramics, plastic or glass in a one-piece or unitary construction.

The bubble is formed from a bubble forming liquid 18 which is contained with the casing 7. The length of the conduit 11 and the quantity of bubble forming liquid 18 contained within the casing 7 is adjusted in all embodiments of the invention so that when the apparatus is inverted from its rest position illustrated by FIG. 1, to its display position illustrated by FIG. 2, the open end 14 of the conduit 11 is at all times above the surface of the liquid and the conduit inlet port 15 is below the surface of the liquid.

The term bubble forming liquid as employed herein, refers to a soap-water (or detergent-water, or other surfactant-water) solution, an oil, or other liquids from which a bubble may be produced, for example, low molecular weight film forming polymeric materials. In order to prevent foaming, foam inhibiting agents such as calcium may be added to the bubble forming liquid.

As a precedent to the formation of a bubble within the apparatus, a film of bubble forming liquid must be applied to the open end 14 of the conduit 11. The application of the bubble forming film to the open end 14 of the conduit is accomplished in the preferred embodiment of the apparatus, by adjusting the length of the conduit and the amount of bubble forming liquid contained within the casing so that when the apparatus is in its rest position, illustrated by FIG. 1, the open end 14 of the conduit contacts the bubble forming liquid 18 contained within the casing 7. The extent to which the conduit penetrates the surface of the bubble forming liquid when the device is in its rest position may be adjusted as desired, so long as the contact is sufficient to apply a film of bubble forming liquid to the open end 14 of the conduit.

Figure 1:
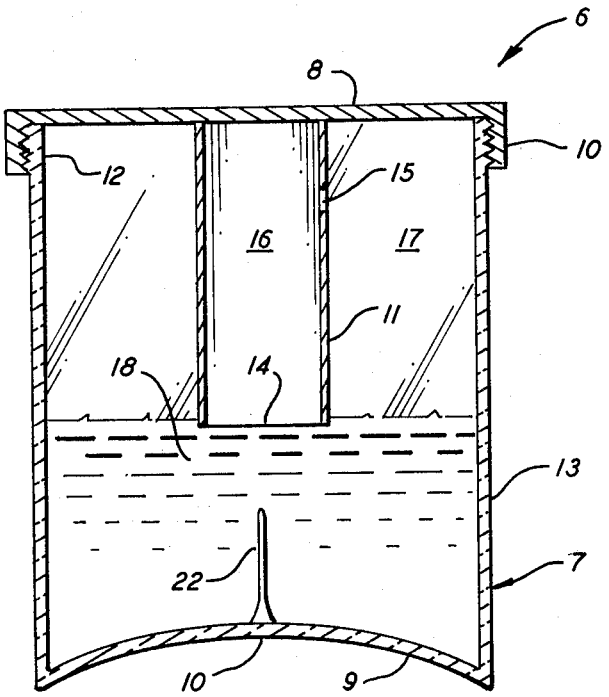
Figure 2:
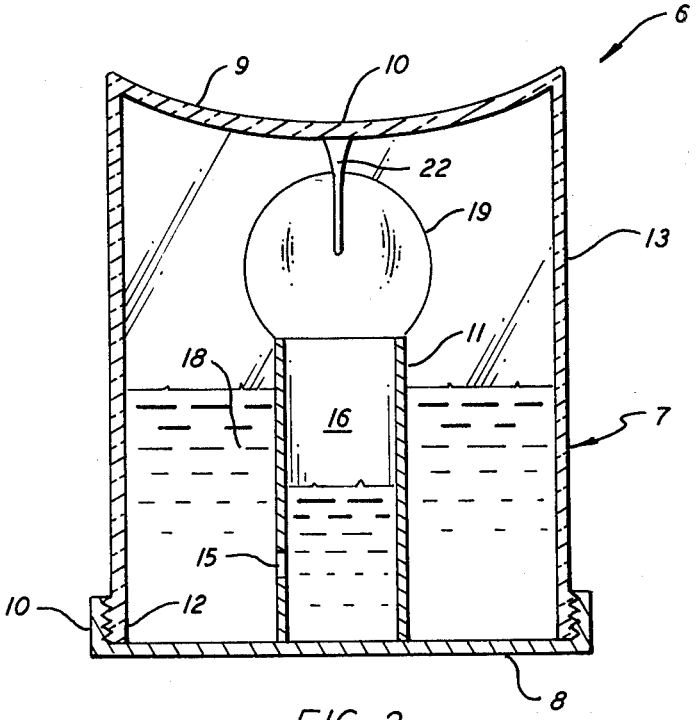
Figure 3:
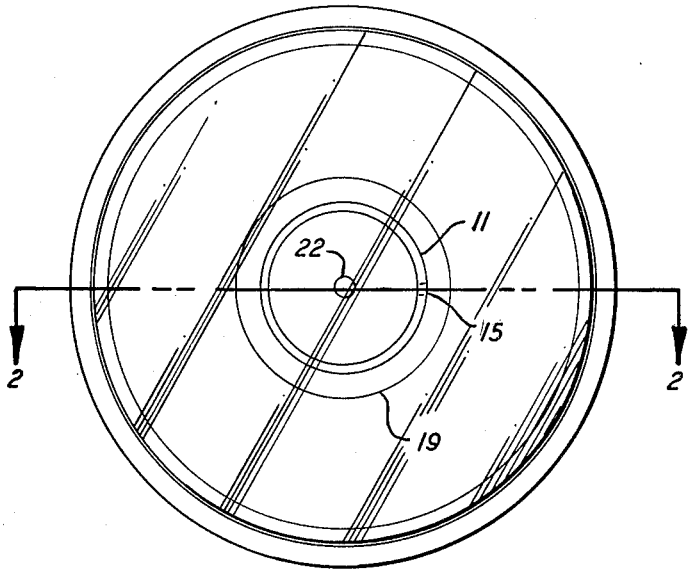

In use, a bubble 19 is produced by inverting the device from its rest position, illustrated by FIG. 1, to its display position, illustrated by FIG. 2. As is apparent from FIG. 2, when the device is in its display position the inlet port 15 will be below the surface of the bubble forming liquid 18 and, therefore, liquid will flow from the casing 8 and into the interior area 16 of the conduit 11 until the level of liquid within the casing 7 is equal to the level of liquid within the interior area 16 of the conduit 11. As the liquid fills the conduit, the pressure within the conduit is increased to a point greater than the pressure within the casing external to the film covering the open end 14 of the casing. Thus, a bubble 19 is formed on the open end 14 of the conduit. The gradual increase in pressure within the conduit produced by the flow of liquid into the conduit produces an amusing and gradual increase in the size of the bubble 19. Significantly, the bubble 19 is formed in the preferred embodiment merely by the inversion of the apparatus from the rest position (FIG. 1) to the display position (FIG. 2). Moreover, the bubble is continuously produced and destroyed as the position of the apparatus is alternated between the rest and the display position.

In an alternative embodiment of the apparatus (FIG. 4), the conduit 11 is secured to a plunger member 21. The plunger 21 cooperates with a sleeve 20 located on the uppermost wall 8 of the casing to provide a liquid tight seal between the plunger 21 and the upper wall 8 of the casing. The plunger 21 is secured at one end to the conduit 11, and extends outwardly through the sleeve 20 to the exterior of the casing. To apply a film of bubble forming liquid to the open end 14 of the conduit 11, the plunger is extended from its rest position illustrated by FIG. 4 inwardly until the open end 14 of the conduit 11 contacts the bubble forming liquid 18. The plunger is then withdrawn from the casing until the conduit is returned to its rest position at the uppermost end of the casing. At this point, the apparatus is inverted to its display position whereupon a bubble is formed in the manner described above. Liquid tight cooperating sleeve and plunger members are well-known to the art and any commercially available sleeve and plunger device may be employed in combination with this apparatus.

The plunger 21 and sleeve member 20 may both be formed of any liquid compatable material such as plastic, glass, or rubber—or, the plunger and sleeve may be formed of different materials. For example, the sleeve may be formed of plastic or rubber and the plunger may be formed of wood, metal, or glass. The plunger 21 may be secured to the conduit with any liquid compatable: glue, or epoxy, or the conduit 11 and plunger 21 may be cast in a one-piece construction—from, for example, plastic or glass.

In the preferred embodiment of the device, the lowermost portion 9 of the casing convexes inwardly so that the lowermost point 10 of the convex surface is approximately vertically aligned with the central vertical axis of the conduit 11.

In use, upon inversion of the apparatus from the rest position (FIG. 1) to the display position (FIG. 2), bubble forming liquid flows downwardly along the convex surface of the casing wall 9 and collects at the lowermost (FIG. 2) point 10 on the convex surface. The liquid collected at point 10 drains downwardly when the device is in the display position onto the surface of the display bubble 19 thereby replenishing the bubble with bubble forming liquid. Thus, a means for replenishing the bubble during display and aiding in the prolongation of the life of the bubble is accomplished simply by providing a vertically aligned convex surface on the casing wall 9 opposite the display bubble 19.

A pin member 22 may be secured at one end to the point 10 of the casing wall 9 such that the central vertical axis of the pin 22 is in generally vertical alignment with the central vertical axis of the conduit member 11. As is illustrated by FIG. 2, the length of the pin 22 is adjusted to that it penetrates the display bubble.

In use, upon inversion of the apparatus from the rest position (FIG. 1) to the display position (FIG. 2), bubble forming liquid flows downwardly along the convex surface of the casing wall 9 and collects at the lowermost (FIG. 2) point 10 on the convex casing wall 9. The liquid then continues to slowly drain downwardly along the pin 22 and onto the surface of the bubble 19. Thus, the flow of bubble forming liquid from the pin 22 and onto the display bubble 19 serves to replenish the bubble with bubble forming liquid during display.

Although in the illustrated embodiment of FIG. 2, the length of the pin 22 is adjusted so that it penetrates the bubble 19; the length of the pin 22 may be adjusted as desired. For example, the length of the pin may be adjusted so that it terminates above the uppermost surface of the inflated bubble. When the pin length is adjusted in this manner, the bubble forming liquid will slowly drip onto the surface of the bubble, whereas when the pin length is adjusted so that the pin penetrates the inflated display bubble, the bubble forming liquid will flow in a continuous stream down the pin and onto the surface of the bubble.

Although in its preferred embodiment the bubble replenishing pin 22 is employed in combination with a convex casing wall 9, the pin 22 may also be employed in combination with a flat casing surface or, with a casing surface of any other desired shape. As is illustrated by FIG. 1, when the apparatus is in its rest position, the pin 22 is submerged in bubble replenishing liquid 18. Thus, when employed in combination with, for example, a flat casing surface, the drainage of excess bubble forming liquid along the pin 22 upon inversion of the apparatus to the display position, provides a flow of bubble replenishing liquid onto the bubble surface.

In order to enhance the function of the bubble replenishing pin 22, circumferential ridges or grooves may be formed in the pin 22 surface. The pin ridges serve to enhance the liquid retaining capacity of the pin 22. Moreover, pins of various shapes may be employed as desired. The bubble replenishing pin 22 may be formed of a transparent glass, or a transparent plastic such as polymethylmethacrylate. The pin 22 may also be formed of a non-transparent or colored wood or plastic so that the pin contrasts with or accentuates the color of the bubble. The pin may be secured to the casing with glue, epoxy or other cementuous material. Or, the casing including the conduit and bubble replenishing pin may be cast in a unitary construction, for example, from glass, or plastic.

The size of the bubble produced by any given conduit will increase as the internal pressure formed within the bubble forming conduit is increased. This may be accomplished by placing the conduit 11 in a casing 7 containing a sufficient amount of liquid so that when the apparatus is in the display position the conduit reservoir 16 will be filled with liquid to a maximum level. As mentioned above, the open end 14 of the conduit 11 must always exceed the level of liquid in the casing when the apparatus is in the display position (FIG. 2). Moreover, in the display position the level of liquid in the conduit and the level of liquid in the casing come to an equilibrium position wherein the liquid in the casing reservoir 17 and the liquid in the conduit reservoir 16 are at the same level. Thus, the level of liquid within the conduit reservoir 16 during display will be increased to a maximum and, hence, the size of the bubble produced will be maximized by first adjusting the level of liquid contained within the casing 7 so that it approaches the open end 14 of the conduit, and secondly by increasing the volume of liquid contained within the casing so that the displacement of the level of the liquid in the casing due to the flow of liquid into the conduit is minimized. Alternatively, the size of the bubble may be reduced by reducing the amount of liquid contained within the casing reservoir.

It is apparent that the conduit inlet port 15 may be placed at any point below the equilibrium level of the liquids in the conduit casing. So long as the inlet port is located below the equilibrium level, it will not be exposed at a point above the level of the liquid in the casing reservoir 17 during the transfer of liquid from the casing to the conduit.

In an alternative embodiment of the bubble forming conduit 11, a conduit cap member is secured to the open end 14 of the bubble forming conduit 11. The conduit cap is provided with a plurality of orifices. In accordance with this embodiment of the conduit 11, a group of overlapping display bubbles may be formed. Moreover, conduit cap members of various designs may be employed to produce a bubble having a desired shape. For example, a conduit cap having a single concentric orifice may be employed to produce a donut shaped display bubble.

In yet another embodiment of the bubble forming conduit a second concentrically disposed internal conduit may be secured within the outer conduit 11. In accordance with this embodiment, an amusing bubble design may be produced comprising an outer bubble formed by the flow of liquid into the first conduit, and an inner bubble encompassed by the outer bubble, formed by the overflow of liquid from the first conduit and into the second conduit by means of a second inner conduit inlet positioned at an appropriate point on the inner conduit. The inlet of the inner conduit is located closer to the open end 14 of the conduit 11 than the inlet of the outer concentric conduit. As a result of the contact between the inner bubble and the outer bubble, the inner and outer bubbles may serve to replenish each other with bubble forming liquid, thereby aiding to prolong the life of one or both bubbles.

The bubble forming conduit may be shaped so that the expansion of the bubble above it completes a desired overall scene or shape. For example, the conduit may be shaped in the form of a mountain range, such that the expansion of the bubble above it completes a scene corresponding to the sun rising over a mountain range. The bubble forming conduit and bubble replenishing member may also be designed and shaped such that the expansion of the bubble within the area which separates them completes a desired overall design or scene. For example, the conduit 11 may be shaped to conform to the torso of a man, and the bubble replenishing member may be formed in the shape of a hat. Thus, upon the expansion of the bubble into the space which separates the hat from the torso conduit a head will be provided thereby completing the figure. Thus, for example the torso and hat member may be designed to correspond to a well-known comic character.

In still another embodiment of the apparatus the conduit may be secured to upper portion 8 of the casing and the length of the conduit 11 and the level of the bubble forming liquid 18 contained within the casing adjusted so that the bubble forming conduit 11 does not contact the bubble forming liquid 18 within the casing 7. When this embodiment is employed the bubble forming conduit outlet 14 is primed, for example, by dipping the conduit outlet 14 in a bath of bubble forming liquid prior to sealing the uppermost portion 8 to the base member 13 of the casing. The term priming as employed herein is intended to refer to the application of a film of bubble forming liquid to the conduit outlet.

With time the surface of the bubble thins. If at any time before the bubble bursts and before the diaphram of bubble forming liquid covering the outlet 14 is dissipated, the apparatus is transferred from the display to the rest position, the flow of bubble forming liquid out through the outlet 14 of the conduit 11 operates to replenish the bubble forming film covering the conduit outlet 14. Moreover, for the embodiment wherein the conduit outlet 14 contacts the bubble forming liquid 18 in the casing (FIGS. 1, 2) this contact further acts to replenish the bubble forming film. For the embodiments of this apparatus wherein the conduit outlet 14 does not contact the bubble forming liquid 18 in the casing, once the outlet 14 is primed, if the apparatus is transferred from the display position to the rest position at any time before the diaphram of bubble forming liquid covering the outlet 14 is destroyed, (i.e. at any time before the bubble bursts), the bubble forming diaphram will be replenished by placing the apparatus in the rest position, and the bubble will be reproduced by returning the apparatus to the display position. Thus, only a single priming of the apparatus is required, and the bubble may be reproduced as desired, so long as the apparatus is transferred to the rest position before the film covering the outlet 14 dissipates.

The bubble is displayed within the apparatus of this invention in an environment of high humidity, and is protected by the casing from stray air currents which might cause the bubble to prematurely burst. An ordinary soap bubble will only last for a matter of seconds in the open air before bursting. However, bubbles displayed within the protective environment of the apparatus of this invention may be preserved for display purposes for from six to 14 hours.

A highly attractive and aesthetically pleasing prismatic effect is produced on the surface of the bubble displayed within the bubble producing apparatus. This invention, therefore, may be employed in connection with advertising matter, or as an amusement device for adults or children.

The application of heat to the casing will cause the bubble to expand and burst, and therefore, the apparatus may be employed as a fire alarm. For example, the bubble may be interconnected with motion detecting means such as a photoelectric cell, which would trigger an alarm when the bubble bursts. Moreover, since the life of the bubble preserved within the device is finite, the burst of the bubble may be employed as a time indicator. In addition, since the walls of the bubble are flexible, the observation of a displacement of the bubble within the apparatus from a known rest position may be employed as an indication of movement.

Electrolytic materials such as a chemical electrolyte, or a finely divided metallic powder may be added to the bubble forming liquid so that the surface of the bubble is conducting. Thus, the expansion of the bubble may be employed in combination with circuit forming contacts so that the expansion of the bubble completes a chemical, physical, mechanical or electrical circuit.

While specific embodiments of the bubble producing and preserving apparatus of this invention have been described with particularity herein, it will be understood that it is intended to cover all changes and modifications of the embodiments of the invention herein chosen for purposes of illustration which do not constitute departures from the spirit and scope of the invention.

I claim:

1. An apparatus for producing, observing and preserving a bubble comprising:

(a) A casing having an upper portion and a lower portion, and (b) bubble forming conduit means attached at one end to the upper portion of the casing, said conduit means having inlet means and a bubble forming outlet means, wherein said outlet is positioned further from said point of attachment than said inlet, and (c) bubble forming liquid contained within the casing such that the bubble forming outlet of the conduit contacts the liquid; and wherein the amount of liquid in the casing is adjusted so that when the casing is inverted, the conduit outlet means is above the surface of said liquid, and the conduit inlet means is below the surface of said liquid so that liquid will flow from the casing and into the conduit thereby causing a bubble to form on the bubble forming conduit outlet.

2. The apparatus according to claim 1 wherein the casing includes bubble replenishing means.

3. The apparatus according to claim 2 wherein the casing convexes inwardly so that when the device is inverted the lower most point on the convex surface opposes the bubble.

4. The apparatus according to claim 3 wherein the convex portion of the casing further includes pin means, wherein the pin is attached at the uppermost point on the convex portion of the casing and extends vertically upwardly, and wherein the length of the pin is adjusted so that when the casing is inverted and a bubble produced the pin penetrates said bubble.

5. The apparatus according to claim 4 wherein the casing further includes port means for introducing bubble forming liquid into the casing or discharging bubble forming liquid from the casing.

6. The apparatus according to claim 5 wherein the conduit and bubble positioned thereon cooperate to complete a figure.

7. The apparatus according to claim 4 wherein the conduit, pin means and bubble positioned on the conduit cooperate to complete a figure.

8. The apparatus according to claim 3 wherein the convex portion of the casing further includes bubble replenishing pin means, and wherein the pin is attached at the uppermost point on the convex portion of the casing and extends generally vertically upwardly.

9. The apparatus according to claim 8 wherein the conduit, pin means and bubble positioned on the conduit cooperate to complete a figure.

10. The apparatus according to claim 3 wherein the conduit, and bubble positioned on the conduit cooperate to complete a figure.

11. The apparatus according to claim 3 wherein said bubble replenishing means, said conduit and the bubble formed on the conduit cooperate to complete a figure.

12. The apparatus according to claim 2 wherein said bubble replenishing means comprises pin means attached to the lower portion of the casing and extends generally vertically upwardly, and wherein the pin is positioned on the lower portion of the casing such that when the casing is inverted said pin means extends toward the bubble.

13. The apparatus according to claim 12 wherein the conduit, pin means and bubble positioned on the conduit cooperate to complete a figure.

14. The apparatus according to claim 2 wherein said bubble replenishing means comprises pin means, wherein said pin is attached at one end to the lower portion of the casing and extends generally vertically upwardly, and the length of the pin is at least long enough so that when the casing is inverted and a bubble produced the pin penetrates said bubble.

15. The apparatus according to claim 14 wherein the conduit, pin means and bubble positioned on the conduit cooperate to complete a figure.

16. The apparatus according to claim 2 wherein the conduit and bubble positioned on the conduit cooperate to complete a figure.

17. The apparatus according to claim 1 wherein the casing further includes port means for introducing bubble forming liquid into the casing and for discharging bubble forming liquid from the casing.

18. The apparatus according to claim 1 wherein the conduit and bubble positioned thereon cooperate to complete a figure.

19. An apparatus for producing, observing and preserving a bubble comprising:

(a) A casing having an upper portion and a lower portion, and (b) bubble forming conduit means attached at one end to the upper portion of the casing, and wherein the conduit includes inlet means and bubble forming outlet means, wherein said inlet means is positioned closer to said point of attachment than said outlet means, and (c) means for applying a film of bubble forming liquid to said bubble forming outlet means, and (d) bubble forming liquid contained within the casing so that when the casing is inverted the bubble forming conduit outlet will be above the surface of the liquid and the conduit inlet will be below the surface of the liquid so that liquid will flow from the casing and into the conduit thereby causing a bubble to form on the bubble producing conduit outlet.

20. An apparatus according to claim 19 wherein the means for applying bubble forming liquid to the bubble forming conduit outlet comprises:

(a) Casing sleeve means, and (b) plunger means secured at one end to the conduit and extending at the other end through the sleeve to the exterior of casing, wherein the sleeve and plunger cooperate such that by extending the plunger inwardly of the casing the bubble forming conduit will contact the bubble forming liquid, and wherein the sleeve and plunger cooperate to suspend the conduit in a position within the casing so that when the casing is inverted the bubble forming conduit outlet will be above the surface of the liquid and the conduit inlet will be below the surface of the liquid.

21. The apparatus according to claim 20 wherein the casing further includes port means for introducing bubble forming liquid into the casing and for discharging bubble forming liquid from the casing.

22. The apparatus according to claim 20 wherein the conduit and bubble positioned on the conduit cooperate to complete a figure.

23. The apparatus according to claim 19 wherein said casing includes bubble replenishing means.

24. The apparatus according to claim 23 wherein to provide said bubble replenishing means the lower portion of the casing convexes inwardly of the casing so that when the casing is inverted the lowermost point on the convex portion of the casing opposes the bubble.

25. The apparatus according to claim 24 wherein the convex portion of the casing further includes bubble replenishing pin means wherein the pin is attached at the uppermost point on the convex portion of the casing and extends vertically upwardly, and wherein the length of the pin is adjusted so that when the casing is inverted and the bubble is formed the pin penetrates the bubble.

26. The apparatus according to claim 25 wherein the casing further includes port means for introducing bubble forming liquid into the casing or discharging bubble forming liquid from the casing.

27. The apparatus according to claim 26 wherein the conduit, pin means, and bubble positioned on the conduit cooperate to complete a figure.

28. The apparatus according to claim 25 wherein the conduit, pin means and bubble positioned on the conduit cooperate to complete a figure.

29. The apparatus according to claim 24 wherein the conduit, and the bubble positioned on the conduit cooperate to complete a figure.

30. The apparatus according to claim 23 wherein the lower portion of the casing includes bubble replenishing pin means, wherein the pin is attached at one end to the lower portion of the casing and extends generally vertically upwardly, and wherein the pin is positioned on the lower portion of the casing such that when the casing is inverted the pin extends towards the bubble.

31. The apparatus according to claim 30 wherein the conduit, pin means and bubble positioned on the conduit cooperate to complete a figure.

32. The apparatus according to claim 23 wherein the lower portion of the casing includes bubble replenishing pin means, wherein the pin is attached at one end to the lower portion of the casing and extends generally vertically upwardly, and wherein the pin is positioned on the lower casing wall and the length of the pin is adjusted so that when the casing is inverted and the bubble is formed the pin penetrates the bubble.

33. The apparatus according to claim 32 wherein the conduit, pin means and bubble positioned on the conduit cooperate to complete a figure.

34. The apparatus according to claim 23 wherein the convex portion of the casing further includes bubble replenishing pin means, and wherein the pin is attached at the uppermost point on the convex portion of the casing and extends generally vertically upwardly.

35. The apparatus according to claim 34, wherein the conduit, pin means, and bubble positioned on the conduit cooperate to complete a figure.

36. The apparatus according to claim 23 wherein the conduit, and the bubble positioned on the conduit cooperate to complete a figure.

37. The apparatus according to claim 23, wherein said bubble replenishing means, said conduit and the bubble formed on the conduit cooperate to complete a figure.

38. The apparatus according to claim 19 wherein the conduit and bubble positioned thereon cooperate to complete a figure.

39. An apparatus for producing, observing and preserving a bubble comprising:

(a) A casing, and (b) bubble producing conduit means mounted within the casing having outlet means and inlet means, and (c) means for applying a film of bubble forming liquid to the conduit outlet, and (d) pressurizing means for cooperating with the conduit inlet for increasing the pressure within the conduit to a point greater than the pressure in the casing outside the conduit so that a bubble forms on the conduit outlet.

40. An apparatus for producing, observing and preserving a bubble comprising:

(a) A casing, and (b) bubble producing conduit means mounted within the casing having an outlet means and inlet means, and (c) means for applying a film of bubble forming liquid to the conduit outlet, and (d) pressurizing means for cooperating with the conduit inlet for increasing the pressure within the conduit to a point greater than the pressure in the casing outside the conduit so that a bubble forms on the conduit outlet, and (e) circuit forming means for cooperating with said bubble to complete a circuit, wherein said circuit is a chemical, electrical, mechanical or physical circuit.

41. A method for producing a bubble comprising:

(a) contacting a bubble forming means with a reservoir of bubble forming liquid to apply a bubble forming film thereto, and (b) removing said bubble forming means having said bubble forming film applied thereto from said reservoir, and (c) forming a bubble on said bubble forming means by pressurizing a space with said liquid reservoir, wherein at least one surface of said space is formed by said bubble forming film.

42. An apparatus for producing observing and preserving a bubble comprising, (a) A casing, and (b) bubble forming conduit means attached at one end to the upper portion of the casing, wherein the said conduit includes inlet means and outlet means, wherein said inlet is closer to said point of attachment than said outlet, and (c) bubble forming film means covering said conduit outlet means, and (d) bubble forming liquid contained within the casing so that when the casing is inverted the conduit outlet will be above the surface of the liquid and the conduit inlet will be below the surface of the liquid so that liquid will flow from the casing and into the conduit thereby causing a bubble to form on the conduit outlet.

43. The apparatus according to claim 42 wherein the apparatus further includes bubble replenishing means.

44. The apparatus according to claim 43 wherein the lower portion of the casing convexes inwardly so that when the apparatus is inverted the lowermost point on the convex surface opposes the bubble.

45. The apparatus according to claim 44 wherein the convex portion of the casing further includes pin means, wherein the pin is attached at the uppermost point of the convex portion of the casing and extends generally vertically upwardly and wherein the length of the pin is adjusted so that when the casing is inverted the pin penetrates the bubble.

46. The apparatus according to claim 44, wherein the convex portion of the casing includes pin means, and wherein the pin attached at the uppermost point on convex portion of the casing and extends generally vertically upwardly.

47. The apparatus according to claim 46 wherein the casing further includes port means for discharging bubble forming liquid from or adding bubble forming liquid to the casing.

48. The apparatus according to claims 42 or 43, wherein said conduit and bubble formed thereon cooperate to complete a figure.

49. The apparatus according to claim 43 wherein said bubble replenishing means comprises pin means, wherein said pin means is attached to the lower portion of the casing and extends generally vertically upwardly, and wherein the pin is positioned on the lower portion of the casing such that when the casing is inverted said pin means extends toward the bubble.

50. The apparatus according to claim 43 wherein said bubble replenishing means comprises pin means, wherein said pin is attached to the lower portion of the casing and extends generally vertically upwardly, and wherein the length of the pin and position of the pin is adjusted so that when the device is inverted the pin penetrates the bubble.

51. The apparatus according to claims 43, 44, 49, 50, 45, 46 or 47 wherein said bubble replenishing means, said conduit and the bubble formed thereon cooperate to complete a figure.

* * * * *